United States Patent [19]

Brauch et al.

[11] Patent Number: 4,651,662

[45] Date of Patent: Mar. 24, 1987

[54] SEWING MACHINE FRAME COVER AND FASTENING THEREFOR

[75] Inventors: Robert B. Brauch, Wayne; Robert Sedlatschek, Bridgewater; Pao-Ter Huang, Edison, all of N.J.

[73] Assignee: SSMC Inc., Stamford, Conn.

[21] Appl. No.: 812,490

[22] Filed: Dec. 23, 1985

[51] Int. Cl.[4] ..... D05B 73/00

[52] U.S. Cl. ..... 112/258; 220/72; 220/327

[58] Field of Search ..... 403/121, 408.1; 292/251; 112/258, 259; 220/72, 71, 327

[56] References Cited

U.S. PATENT DOCUMENTS 1,928,486 9/1933 Gruman ..... 112/258

2,987,021 6/1961 Meier ..... 112/258

FOREIGN PATENT DOCUMENTS 2403480 5/1979 France ..... 403/121

*Primary Examiner*—Werner H. Schroeder

*Assistant Examiner*—Andrew M. Falik

*Attorney, Agent, or Firm*—Robert E. Smith

[57] ABSTRACT

A sewing machine frame and cover construction and fastening means for securing a warped cover in place over a frame opening without imparting frame distorting stresses. To obviate imparting stresses to the sewing machine frame as result of clamping a warped cover thereto, surfaces are provided at locations on the frame and cover chosen so that the surfaces engage simultaneously in spaced localized areas when the warped cover is positioned loosely over the frame opening. Fastening means located within the localized areas of engagement of these surfaces clamp the cover securely in place without disturbing the warp.

5 Claims, 5 Drawing Figures

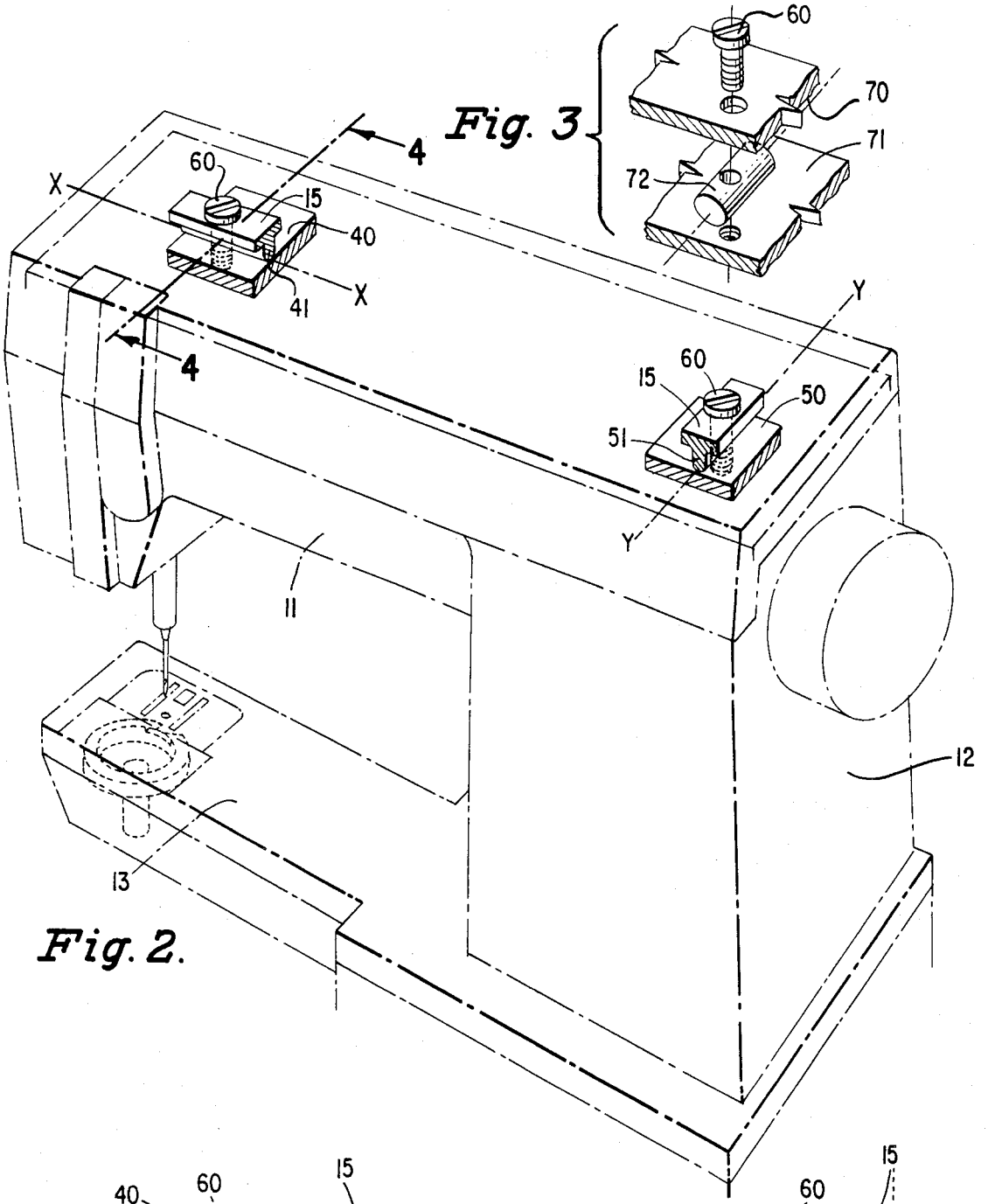
Fig. 3
Fig. 2.
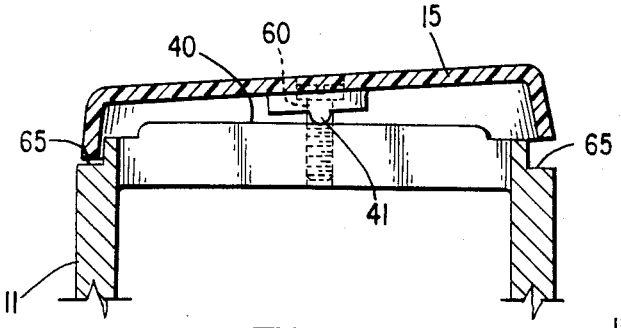
Fig. 4.
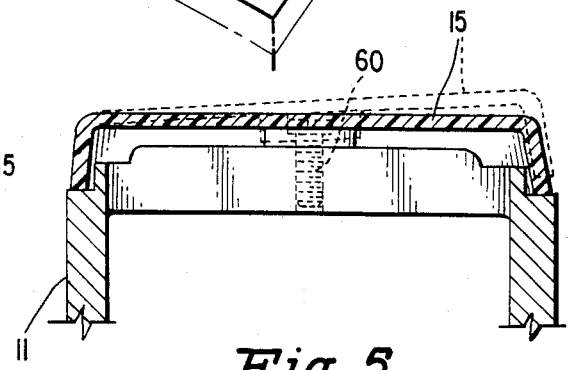
Fig. 5.
(PRIOR ART)

SEWING MACHINE FRAME COVER AND FASTENING THEREFOR

DESCRIPTION

BACKGROUND OF THE INVENTION

1. Field of the Invention

This invention relates to sewing machine frames which include one or more removable covers, and more particularly, to a novel frame and cover construction and fastening means for securing the cover to the frame without disturbing the dimensional stability of the sewing machine frame.

2. Description of the Prior Art

U.S. Pat. Nos. 2,678,011, May 11, 1954, Peets et al and 3,467,041, Sept. 16, 1969, Greulich, typify the prior art approach to sewing machine frame cover construction and fastening. In the prior art approach contiguous surfaces usually planer mating surfaces, are formed on the frame and on the cover and fasteners are provided designed to draw and maintain all of the mating surfaces into engagement with each other. Because sewing machine frames and covers were fabricated heretofor primarily of metal without severe warpage characteristics and because machining steps to correct any slight dimensional variations were acceptable in the prior art, this typical mode of frame and cover construction and fastening was acceptable and provided uniformly spaced joints between the parts.

With the advent of modern day synthetic materials for sewing machine frames and covers, the susceptibility of warpage, particularly of covers, has increased and competitive pressures have militated against use of costly additional machining steps in frame and cover manufacture to correct for such warpage of parts. As a result, a warped cover, if shaped and fastened as in the prior art, would be distorted by tightening of the fastening means and consequently, would impart undesirable stresses to the sewing machine frame which can cause misalignment of the stitch forming instrumentalities and contribute to faulty or inoperative stitch formation.

SUMMARY OF THE INVENTION

It is an object of this invention to provide a sewing machine frame and cover construction and fastening arrangement which will secure warped covers firmly in place closing a frame opening without applying undesirable stresses to the sewing machine frame due to warpage of the cover.

This object of the invention is attained by forming the sewing machine frame and the cover with two spaced sets of interengaging surfaces which in the warped state of the cover contact each other only in small localized areas within each of which areas a fastening is located so that tightening of the fastenings firmly secure the cover in place without changing the warped configuration of the cover, thus avoiding stress transfer to the sewing machine frame.

Attainment of this object may be implemented by the selective placement of separate rib elements between the frame and cover in locations appropriate to the particular warped condition of the cover with the rib elements defining the localized areas of contact between the parts. A particularly workable form of this invention is attained by the provision of spaced sets of interengaging surfaces between the frame and cover members by use of rib elements as described above providing for contact along two non-colinear substantially straight lines with a fastening means arranged intersecting each of said straight line contact surfaces and substantially perpendicular thereto.

In practice, given a particular frame and cover design, consistent use of the same type of synthetic material and consistent use of particular molding conditions for the parts, it has been found that the warpage characteristics of the parts, particularly of the cover members, will be remarkably uniform. It is possible, therefore, to attain the objects of this invention by forming the rib element means which provide the localized linear contact between the parts as an integral molded part of the cover or frame member.

DESCRIPTION OF THE DRAWINGS

With the above and other objects and advantages in view, as will hereinafter appear, this invention comprises the devices, combinations, and arrangements of parts hereinafter described and illustrated in the accompanying drawings of preferred embodiments in which:

FIG. 2 is a perspective view of a sewing machine similar to that of FIG. 1 showing the top cover in place on the sewing machine frame and with portions of the top cover broken away to expose various forms of fastening means in accordance with this invention;

FIG. 3 is an exploded perspective view of a modified form of construction providing interengaging surfaces between the sewing machine frame and cover;

FIG. 4 is an enlarged cross sectional view taken substantially along line 4—4 of FIG. 2 with the warpage of the top cover exaggerated; and FIG. 5 is a cross sectional view similar to that of FIG. 3 illustrating a typical prior art form of cover fastening construction.

DESCRIPTION OF THE PREFERRED EMBODIMENT

Figure 1:
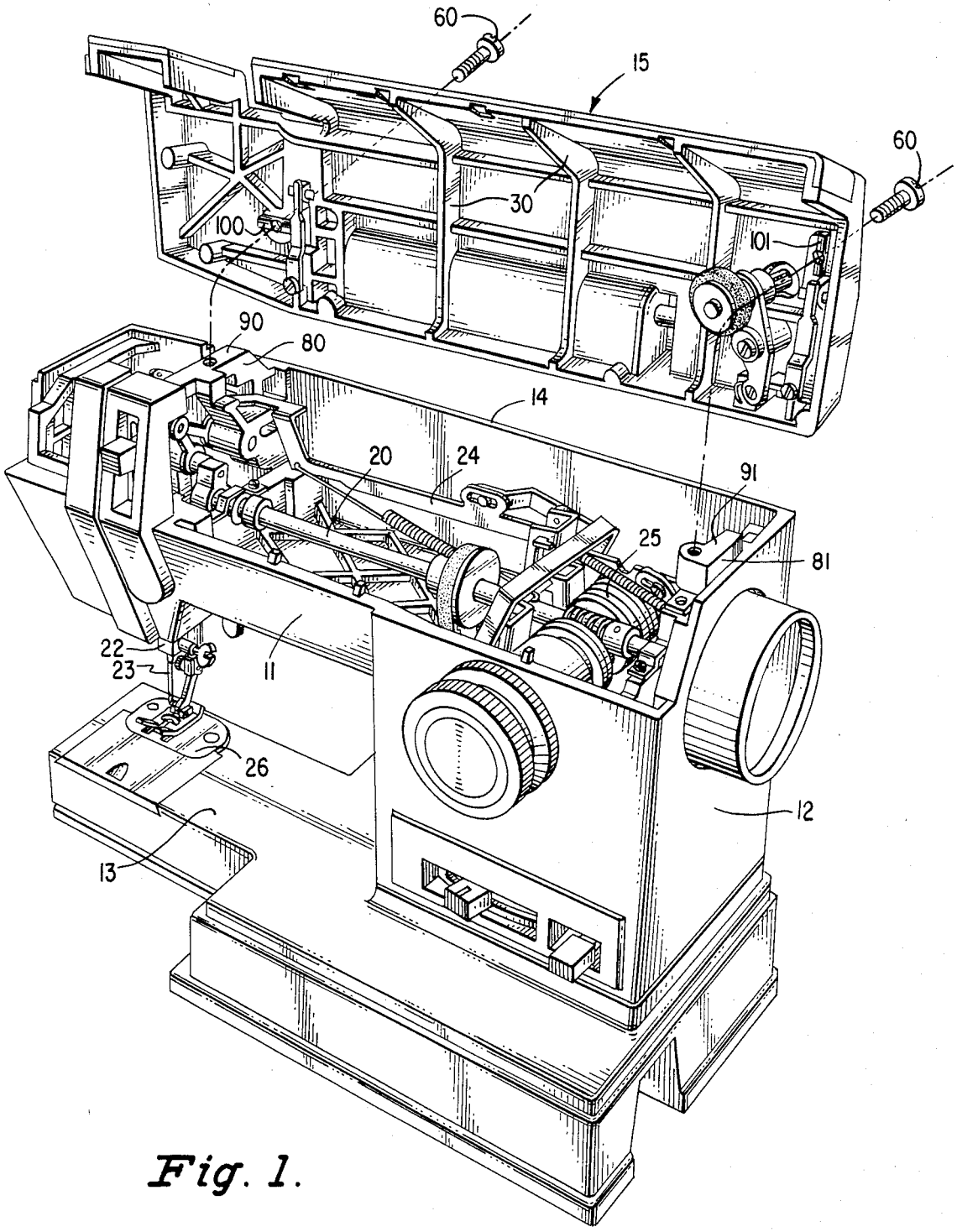
FIG. 1 is a perspective view of a sewing machine showing the top cover removed and turned back to expose the underside and illustrating a construction and cover fastening means in accordance with this invention.

Referring to FIG. 1, 11 indicates the bracket arm portion of a sewing machine frame which projects from a standard 12 rising from a bed portion 13 of the frame. An opening 14 formed across the top of the bracket arm 11 and standard 12 is adapted to be closed by a top cover 15.

Preferably, the top cover 15 is configured so as to be complemental to the sewing machine frame opening 14 and to provide a complete closure therefor when positioned over the opening. The mechanism within the frame which may be enclosed when the cover 15 is in place may include a main drive shaft 20, a crank mechanism 21 for operating an endwise reciprocable needle bar 22 to which a needle 23 is secured, needle jogging mechanism 24 and pattern cam 25 or other memory means for controlling the formation of stitch patterns. The needle 23 is reciprocated through an aperture in a throat plate 26 on the bed 13 into cooperation with stitch forming instrumentalities (not shown) in the bed in the formation of stitches. These mechanisms within the frame, which may be of any well known construction in the art, are highly critical as to their required spacial relation to each other, which spacial relationship if not accurately maintained can result in faulty or inoperative stitch formation.

One source of misalignment of operating mechanism in a sewing machine frame can be attributable to the forces imparted to the frame by the means used to secure a warped cover plate over a frame opening.

It is known to include reinforcing ribs such as those indicated at 30 on the top cover 15 in selected locations in an effort to minimize warpage. Such measures, by increasing the rigidity of a cover member, may, however, increase the problem of frame misalignment where prior art types of cover fastenings are employed by increasing the forces necessary to overcome the warpage.

It is also known in the art to employ machining steps to correct warpage occurring during the forming processes for the frame or cover parts, however, such corrective measures reduce the cost effectiveness of sewing machine manufacture.

FIGS. 1, 2, 3 and 4 illustrate the novel configuration of sewing machine frame cover and fastening means of this invention wherein secure fastening of a warped cover to the sewing machine frame will not impart forces causing distortion of the frame.

In essence, as shown in FIG. 2, this invention comprises the provision of two sets localized of interengaging surfaces on the frame and cover of which the position and arrangement are chosen such that both sets simultaneously engage each other in separate small localized areas when the cover having warped configuration is positioned closing the frame opening. In FIG. 2, two flat surfaces 40 and 50 are illustrated being formed in spaced locations on the sewing machine frame. On the cover member 15, two short rib elements 41 and 51 are formed to depend in locations chosen so that in the warped configuration of the cover each rib element makes line contact simultaneously with a respective one of the frame flat surfacs 40, 50; the rib element 41 along line X-X with surface 40, and the rib element 51 along line X-Y with surface 50. A fastening screw 60 is provided within each of the two localized areas, preferably arranged perpindicular to the flat surfaces 40 and 50 and within the length of each rib element, each traversing one of the lines X-X and Y-Y.

As illustrated in FIG. 4, because of the small localized area of contact between the cover and sewing machine frame and preferably the line contact therebetween at each of the localized areas, tightening of the screw 60 will not change the warped configuration of the cover 15. If the localized areas of contact between the cover and frame are properly chosen and, preferably if the lines of contact X-X and Y-Y are not colinear, the cover will be securely fastened in place and no abnormal forces attributed to the warpage in the cover will be transmitted to the frame.

Since a most usual form of cover warpage is that in which the cover twists slightly about its lengthwise central axis, a particularly effective orientation for the lines X-X and Y-Y is as shown in FIG. 2 with the lines of contact substantially perpendicular to each other and in substantially parallel planes.

Any variations in the juncture between cover and frame may be deemphasized, for instance, by providing a rabbet 65 along the frame opening 14.

By contrast, FIG. 5 illustrates a typical prior art frame cover and fastening arrangement wherein upon tightening of the fastening screw 60, the cover 15 will be drawn into contact about the entire perphery of the frame opening 14. If the dashed line position of the cover indicates an initial warped cover configuration, the force incident to overcoming such warpage will be transmitted to the sewing machine frame.

It will be appreciated in the construction of this invention illustrated in FIG. 2, that the specific interengaging surfaces may be reversed, i.e., the flat surfaces formed on the cover and the rib elements formed on the sewing machine frame, or those surfaces of any one of the two sets may be reversed.

Moreover, the specific form of the surfaces may be varied. As shown in FIG. 3, both the cover 15 and the sewing machine frame may be formed with localized flat surfaces 70, 71 and a short rod 72 interposed therebetween in an appropriate angular position about the fastening screw 60 to make line contact with both surfaces 70 and 71 along the entire length of the rod 72 before the screw 60 is tightened.

It has been found that with any given design of frame and cover, by maintaining uniformity of materials and processes in the formation thereof, the warpage which is experienced between the cover and frame will be remarkably uniform in character. As a result, it is feasable to decide upon the location and arrangement of the two sets of interengaging surfaces between the frame and cover as part of the basic design of these parts. This is of particular cost effectiveness where the parts are molded of glass reinforced composition and the sets of interengaging surfaces can be formed in the molding process. The construction shown in FIG. 1 illustrates an embodiment of this invention in which the interengaging surfaces between the frame and cover are formed incident to the molding processes for these parts.

A web 80 spanning the bracket arm 11 of the sewing machine frame is formed with a flat surface 90 with which a rib element 100 molded on the cover 15 engages. A boss 81 on one wall of the sewing machine frame standard 12 is formed with a flat surface 91 engaged by a rib element 101 molded on the cover 15. Screws 60 secure the cover in place closing the frame opening in the same manner as is illustrated in FIGS. 2 and 4.

Having set forth the nature of this invention, what is claimed herein is:

1. A sewing machine frame member having an opening, and a warped cover member having a shape generally similar to said frame opening and adapted to provide a closure therefor, means for fastening said cover member to said frame member in position closing said frame opening, said means comprsing:

two spaced sets of interengaging surfaces one of each set formed on said frame and cover members, each of said sets of interengaging surfaces including an insolated flat surface formed on one of said members and a rib element means projecting from the other of said members providing for line contact substantially along a straight line with said flat surface, and separate fastening means associated one with each of said two sets of interengaging surfaces;

each said fastening means intersecting the rib element means of that set of interengaging surfaces with which it is associated and arranged substantially perpendicular to the line of contact between said members provided by said interengaging surfaces.

2. A sewing machine frame and cover member arrangement as set forth in claim 1 in which said two spaced sets of interengaging surfaces are each oriented with respect to the warped configuration of said cover member so as to arrange said straight lines along which said sets of interengaging surfaces provide contact in non-colinear relation to each other.

3. A sewing machine frame and cover member arrangement as set forth in claim 1 in which said two spaced sets of interengaging surfaces are each oriented with respect to the warped configuration of said cover member so as to arrange said straight lines along which said sets of interengaging surfaces provide contact in substantially perpendicular relation to each other and in planes which are substantially parallel.

4. A sewing machine frame and cover member arrangement as set forth in claim 1 in which at least one of said sets of interengaging surfaces includes opposed isolated flat surfaces formed one on each of said members, and in which said rib element comprises a rod interposed between said opposed flat surfaces.

5. A sewing machine frame member having an opening, a cover member having a shape generally similar to that of said frame opening and adapted to provide a closure therefor, said cover member having a warped configuration imperfectly matching that of said frame member opening, and means for securely attaching said cover member to said frame member in a position closing said frame opening, said means comprising two sets of interengaging surfaces on said frame member and said cover member arranged wherein one of the said surfaces includes means whereby the surfaces of each set simultaneously engage each other each in a line contact when said cover member having warped configuration is loosely positioned closing said frame member opening, a fastening means arranged within each of said localized areas of engagement for clamping said cover member securely to said frame member in substantially warped configuration of said cover member.

* * * * *